US005853196A

United States Patent [19]

Wilkus et al.

[11] Patent Number: 5,853,196

[45] Date of Patent: Dec. 29, 1998

[54] ELECTRONIC SHELF LABELS FOR MOUNTING IN C CHANNELS OF RETAIL SHELVES AND METHOD FOR MOUNTING

[75] Inventors: Stephen A. Wilkus, Lincroft; James G. Evans, Colts Neck, both of N.J.; Jeffry S. Rollins, Lawrenceville, Ga.

[73] Assignee: NCR Corporation, Dayton, Ohio

[21] Appl. No.: 669,115

[22] Filed: Jun. 24, 1996

[51] Int. Cl.[6] ..... B42D 15/00

[52] U.S. Cl. ..... 283/81; 283/100; 283/67

[58] Field of Search ..... 40/642.02, 661.03, 40/666, 649; 283/93, 81, 100, 67; D20/22, 44, 43

[56] References Cited

U.S. PATENT DOCUMENTS

| | | | |
|---|---|---|---|
| 2,576,838 | 11/1951 | Jimenez et al. | 40/661.3 |
| 3,196,564 | 7/1965 | Bodeker | 40/666 |
| 4,306,366 | 12/1981 | Taub | 40/649 |
| 5,575,100 | 11/1996 | Marvin et al. | 40/642.2 |

FOREIGN PATENT DOCUMENTS

| | | |
|---|---|---|
| 2706665 | 12/1994 | France . |
| 2249854 | 5/1992 | United Kingdom . |

OTHER PUBLICATIONS

"Price Tag Moulding", Loxem, p. 30.

*Primary Examiner*—Willmon Fridie, Jr.
*Attorney, Agent, or Firm*—Charlene Stukenborg

[57] ABSTRACT

An electronic shelf label has a housing which is formed oversized and later shaped to fit securely into a C channel of a targeted shelf, without requiring any additional hardware fixtures for mounting.

7 Claims, 3 Drawing Sheets

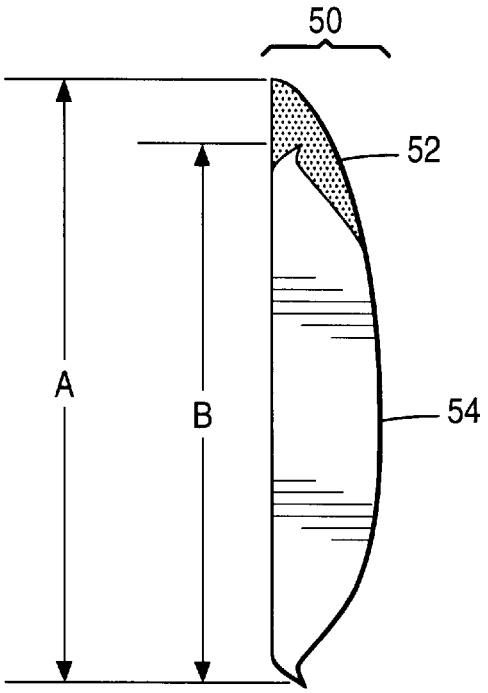
FIG. 2
FIG. 3
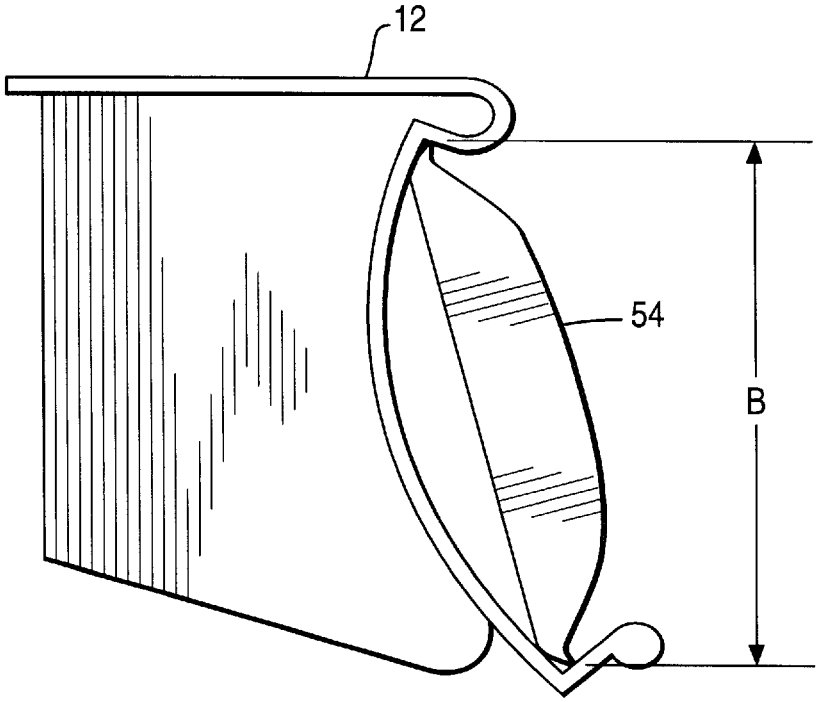

ELECTRONIC SHELF LABELS FOR MOUNTING IN C CHANNELS OF RETAIL SHELVES AND METHOD FOR MOUNTING

BACKGROUND OF THE INVENTION

The present invention relates to electronic shelf labels and, in particular, to an electronic shelf label for mounting in a C channel of a retail shelf and to a method of mounting the label.

Electronic shelf labels are mounted throughout a store or business to display information about products located on shelves near the labels. The shelves typically have a C channel at the front edge. Presently, electronic shelf labels are mounted to the shelves with additional hardware fixtures, some of which attach to the shelves outside the C channel with screws or other fasteners. Additional hardware fixtures may also consist of long rails in which the labels fit in order to protect the labels from impacts, such as from shopping carts or forklifts. These additional hardware fixtures may also move the label out farther from the shelving, increasing the likelihood that the label will be knocked off the shelf. These additional hardware fixtures increase the unit cost and the installation time for each label.

Another difficulty in providing and mounting shelf labels is that the dimension of the opening of various C channels can vary by ¼ inch to ⅜ inch between shelf manufacturers or between stores.

There is a need for a label which can be mounted securely in a C channel of a shelf despite wide variations in C channels among retail shelves of various stores and which does not require additional hardware fixtures.

SUMMARY OF THE INVENTION

In accordance with the teachings of the present invention, a shelf label housing is formed oversized and later shaped to fit securely into a C channel of a targeted shelf.

It is an object of the present invention to provide an electronic shelf label which mounts securely in the C channel of retail shelves with minimal installation effort or cost.

It is another object of the present invention to provide an electronic shelf label which mounts in the C channel of retail shelves, reducing the likelihood of damage due to impacts, such as from shopping carts.

It is still another object of the present invention to reduce the exposure of corners and edges of labels which might interfere with normal store activities.

It is still another object of the present invention to provide an electronic shelf label which is easily installed while improving the aesthetic appearance of the shelf label.

It is yet another object of the present invention to provide an electronic shelf label which is formed oversized and is later fitted for a targeted shelf.

BRIEF DESCRIPTION OF THE DRAWINGS

Additional benefits and advantages of the present invention will become apparent to those skilled in the art to which this invention relates from the subsequent description of the preferred embodiments and the appended claims, taken in conjunction with the accompanying drawings, in which:

FIG. 2 shows an electronic shelf label according to a first embodiment of the present invention;

FIG. 3 shows the electronic shelf label of FIG. 2 mounted securely in the C channel of FIG. 1;

DETAILED DESCRIPTION

Figure 1:
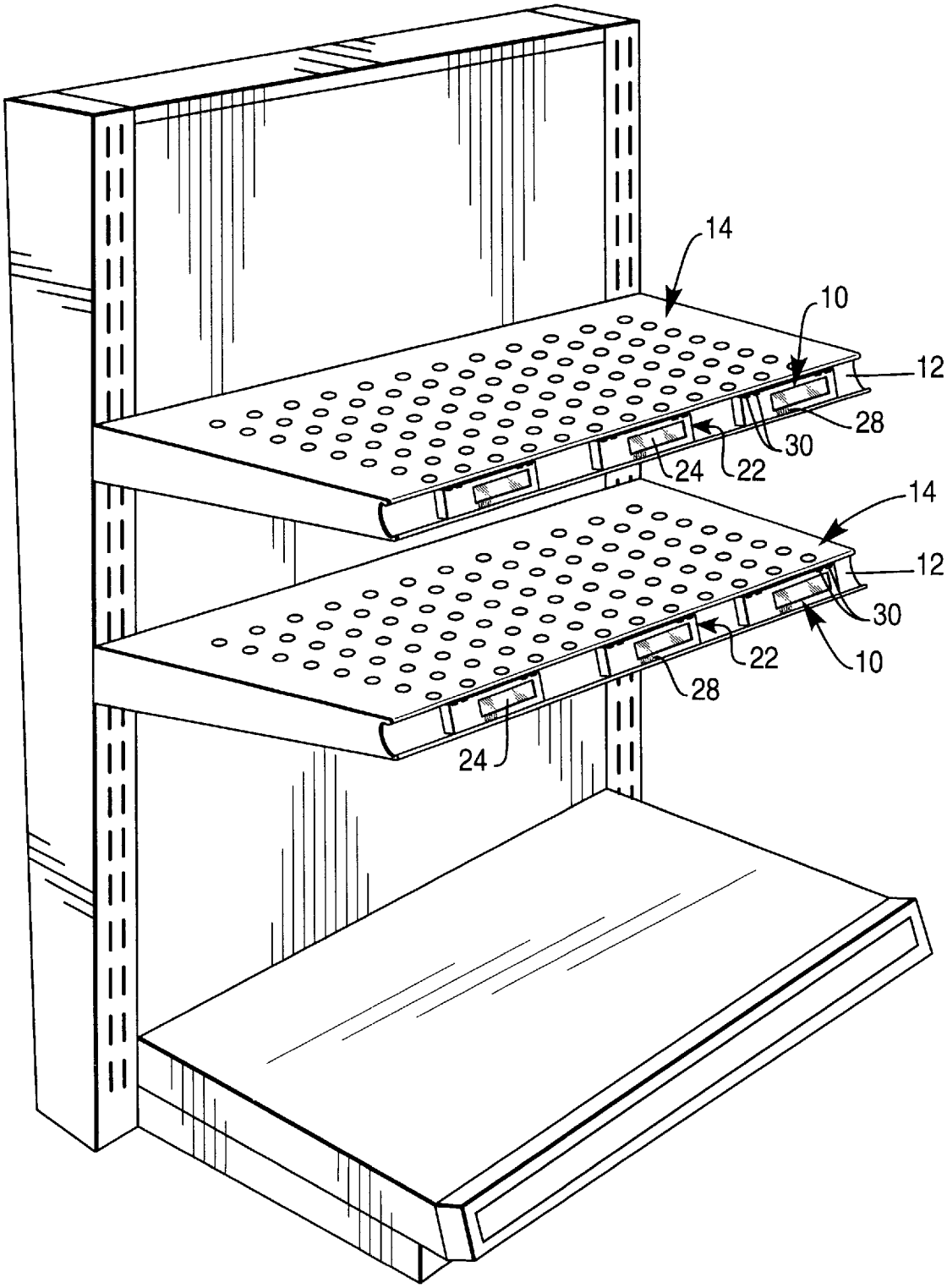
FIG. 1 shows a shelf with an electronic shelf label mounted according to the present invention.

Referring now to the drawings, in which like-referenced characters indicate corresponding elements throughout the several views, attention is first drawn to FIG. 1 which shows an electronic shelf label 10 mounted in a C channel 12 of a retail shelf 14. Electronic shelf label 10 has a housing 22, a display 24, and circuitry. Electronic shelf label 10 may additionally have a tag with printed indicia 28. Electronic shelf label 10 may additionally have slots 30 in the housing 22 to aid in removal from the C channel. The electronic shelf label housing 22 is formed by a molding process, preferably by injection molding. Any plastic material such as thermoplastic, ultraviolet set plastic, reactive plastics or epoxies may be used, including other materials which can provide label housings according to the present invention. The material used must have some flexibility to allow slight deformation during installation. The label housing may be formed in a single size mold. Alternatively, the label housing may be formed having a height dimension smaller than required for shelf labels in general, then additional, separate layers of molded material, preferably of the same material as the housing, may be formed to provided a larger height dimension.

Referring to FIG. 2, an electronic shelf label housing 50 of a first embodiment of the present invention is formed with an overall height dimension A which is intentionally oversized The label housing 50 has a height at least slightly larger, and may be up to ⅜ inches larger, than or equal to the largest opening dimension of any standard shelf C channel. Each label housing 50 is formed with the same overall dimension regardless of the dimension of the shelf the label is intended for, even if the targeted shelf is known. For simplicity only one label housing 50 will be described as all the label housings are made substantially the same.

Sometime before installation, the targeted shelf is determined and the required height dimension of the label housing is determined. These determinations may occur when a preprinted tag is attached to the label housing, indicating that the label is targeted for a particular shelf in a particular store. The label housing 50 having a dimension A is shaped to provide a label housing 54 with the required dimension B. A mechanical tool such as a mechanical router, a cutter or a shaper removes any excess portion 52 from oversized label housing 50 to provide label housing 54 having the required height B. If the label housing was formed with an additional, separate layer of molded material (or layered stack of several moldings), one or more of the layers is removed to achieve the desired height B. Once the label housing is installed securely in the C channel, compression forces acting on the top and bottom of the label keep the separate molding layers firmly in place.

FIG. 3 shows the label installed in the C channel 12 having a C channel opening height B, located on the targeted shelf. The height of the label housing 54 and the overall dimension of the C channel are substantially the same. The ends of the label housing 54 deform slightly when pushed into the C channel so that the ends of the label housing catch on the ends of the C channel, as shown in FIG. 3. Pressing or hammering with a soft-headed ball peen hammer applies sufficient force to slightly deform the ends of label housing 54. (A cover plate may additionally be used to protect the label.) A key slot in one end of the label provides for easy removal of the label from the C channel into which it is fit. Thus, the label is installed securely in the C channel 12 of the targeted shelf without additional hardware.

The present invention provides an advantage in that all label housings can be formed having the same height dimension. Later when a targeted shelf is determined, a specific label housing can be easily shaped to press fit securely into the C channel of the targeted shelf.

Figure 4:
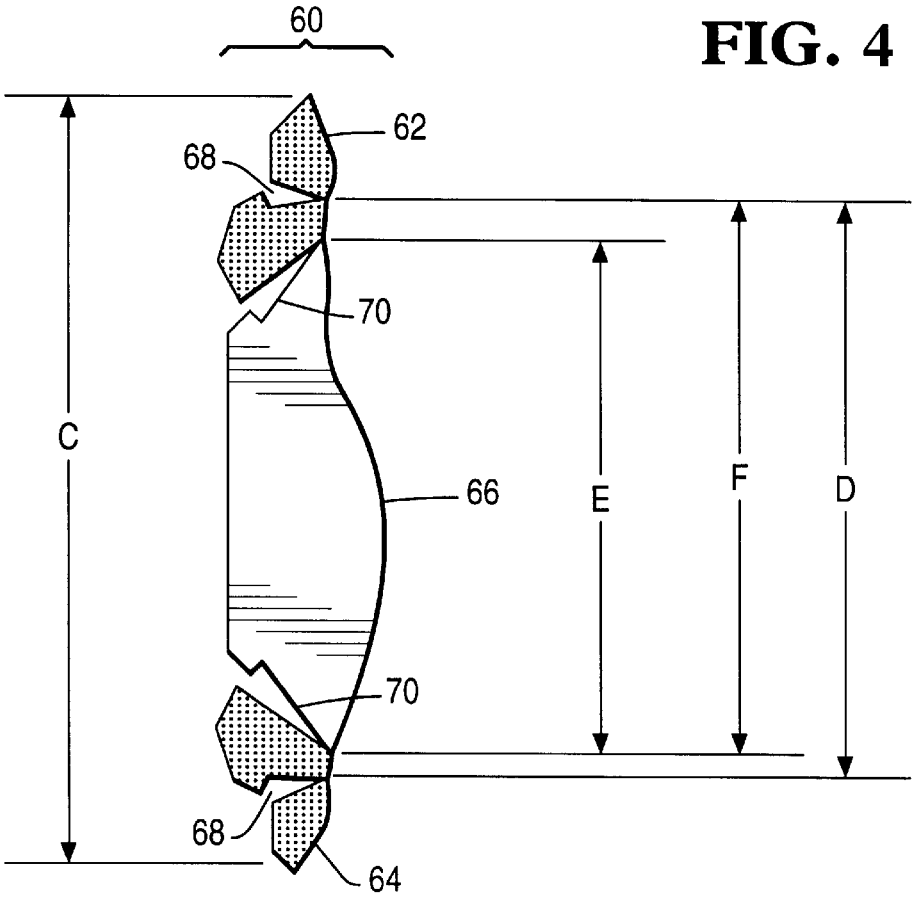
FIG. 4 shows an electronic shelf label according to a second embodiment of the present invention.

Referring to FIG. 4, an electronic shelf label housing 60 of a second embodiment of the present invention is formed with an overall height dimension C which is intentionally oversized. The label housing 60 has a height at least slightly larger, and may be up to ⅜ inches larger, than or equal to the largest opening dimension of any standard shelf C channel. Each label housing 60 is formed with the same overall dimension regardless of the dimension of the shelf the label is intended for, even if the targeted shelf is known. The label housing 60 has breakaway notches 68 for adjusting the overall dimension of the label housing as described below. The molded material comprising the areas between the breakaway notches 68 may be molded in a single mold operation or may include separate, molded layers as described hereinabove. For simplicity only one label housing 60 will be described as all the label housings are made substantially the same.

Sometime before installation of the label, including the time immediately before the label is mounted in the C channel of a shelf, the required height dimension of the label housing is determined. The breakaway notches 68 provide weak points, which break away from the label housing 60 when pressure is applied either manually or with a portable tool. The breakaway notches as shown in FIG. 4 include a second notch 70 which prevents sliding of the molded pieces which could cause them to shear off when installed in the C channel. Additionally, if desired, the breakaway notches may be shaped so that removing a top portion tilts the label back for bottom shelf mounting. Alternatively, the breakaway notches may be shaped so that removing a bottom portion tilts the label forward for top shelf mounting. This is achieved by changing the angle at which the portions will breakaway. Depending on which portions are excess portions as shown in regions 62 and 64 to be removed, the overall dimension of the label housing 66 can be selected to range from a required height D to a required height E with various tilt angles depending on which portions are removed. Although the label housing shown in FIG. 4 shows four breakaway notches, any number of breakaway notches may be provided to give desired flexibility in mounting size and tilt angles.

Figure 5:
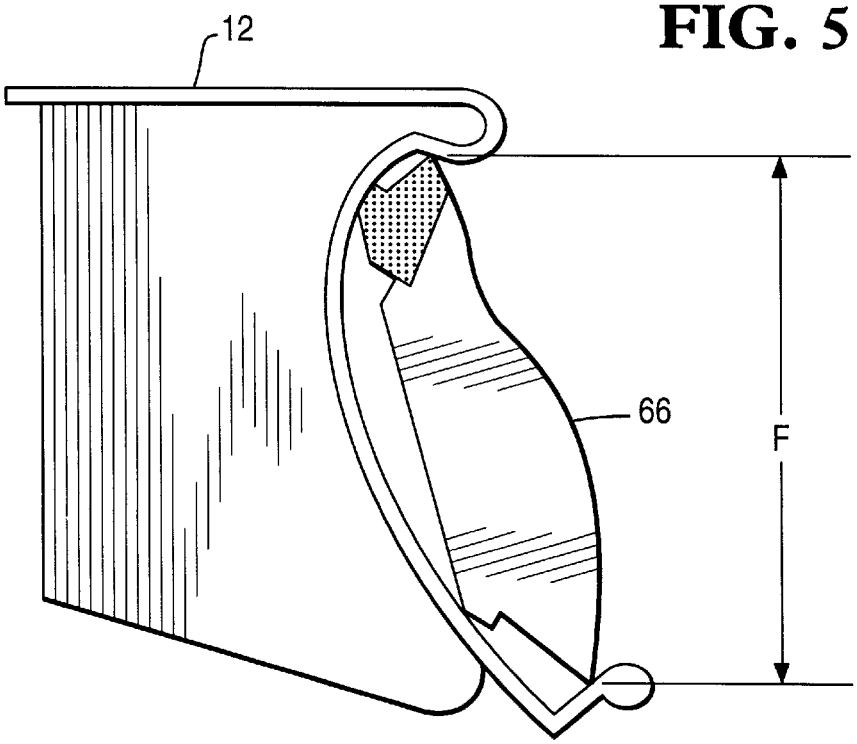
FIG. 5 shows the electronic shelf label of FIG. 4 mounted securely in the C channel of FIG. 1.

FIG. 5 shows the label installed in the C channel 12 having a C channel opening height F, located on the targeted shelf. The height of the label housing 66 and the overall dimension of the C channel are substantially the same. The ends of the label housing 66 deform slightly when pushed into the C channel so that the ends of the label housing catch on the ends of the C channel, as shown in FIG. 5. The breakaway notches 68 not removed before installation become compressed upon installation in the C channel as shown in FIG. 5. Pressing or hammering with a soft-headed ball peen hammer applies sufficient force to slightly deform the ends of label housing 66. (A cover plate may additionally be used to protect the label.) A key slot in one end of the label housing provides for easy removal of the label from the C channel into which it is fit. Thus, the label is installed securely in the C channel 12 of the targeted shelf without additional hardware.

This second embodiment of the present invention provides an additional advantage that label housings can be modified without special tools immediately before installation in a shelf. The label housing is modified to fit securely in the C channel of the shelf without additional hardware fixtures.

Although the labels to be formed in accordance with the present invention may have a variety of depth dimensions, it is contemplated that at least the top and bottom edges of the label will fit securely within the C channel. Additional advantages in reducing interference with normal store activities can be achieved by providing a label which has an overall depth dimension which fits inside the C channel. In any of the above embodiments, adhesive or tacky material may be applied to the top and bottom edges of the label housing to prevent the label sliding down the C channel. The adhesive should provide for removal by store personnel as needed.

Although the invention has been described with particular reference to certain preferred embodiments thereof, variations and modifications of the present invention can be effected within the spirit and scope of the following claims.

What is claimed is:

1. A method of mounting an electronic shelf label in a C channel of a shelf, comprising the steps of:

providing an electronic shelf label having a housing having a height dimension substantially the same as the dimension of the C channel opening and a depth dimension at the top and bottom of the label less than the depth dimension of the C channel, wherein the step of providing an electronic shelf label further comprises the steps of:

molding a housing having a height dimension at least slightly larger than or equal to the largest opening dimension of any standard shelf C channel;

determining the dimension of the shelf C channel opening for installation;

removing any excess portion of the housing so that the height dimension of the housing is substantially the same as the dimension of the shelf C channel opening; and applying light pressure to the face of the label to force the label to fit securely into the C channel, without any additional hardware fixtures.

2. The method of claim 1 wherein the step of removing the portion of the housing is performed using a mechanical router.

3. The method of claim 1 wherein the step of removing the portion of the housing is performed using a cutter.

4. The method of claim 1 wherein the step of removing the portion of the housing is performed by putting pressure on breakaway notches formed in the housing.

5. The method of claim 1 wherein the step of determining the dimension of the shelf C channel opening for installation occurs when a preprinted tag is applied to the label indicating a targeted shelf.

6. An electronic shelf label for mounting in a C channel of a shelf, comprising:

a housing having a height dimension at least slightly larger than or equal to the largest opening dimension of any standard shelf C channel, a depth dimension at the top and bottom of the label less than the depth dimension of the C channel, and having breakaway notches formed in the back side of the housing.

7. The label of claim 6 wherein said breakaway notches formed in the backside of the housing breakaway at varying angles so tilt of the label may be controlled depending on whether portions from the top or the bottom of the label housing are removed.

* * * * *